US007302924B2

(12) United States Patent
Roerig et al.

(10) Patent No.: US 7,302,924 B2
(45) Date of Patent: Dec. 4, 2007

(54) SWITCHABLE DRAG LEVER OF A VALVE TIMING MECHANISM OF AN INTERNAL COMBUSTION ENGINE

(75) Inventors: Bodo Roerig, Weisendorf (DE); Stefan Gemein, Fürth (DE); Nicola Morelli, Fürth (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/499,580

(22) Filed: Aug. 4, 2006

(65) Prior Publication Data

US 2007/0028879 A1 Feb. 8, 2007

(30) Foreign Application Priority Data

Aug. 5, 2005 (DE) ..... 10 2005 037 051

(51) Int. Cl.
*F01L 1/18* (2006.01)

(52) U.S. Cl. ..... 123/90.39; 123/90.41; 123/90.44; 123/90.45; 123/198 F; 74/559; 74/569

(58) Field of Classification Search ..... 123/90.39
See application file for complete search history.

(56) References Cited

U.S. PATENT DOCUMENTS

| | | | | |
|---|---|---|---|---|
| 6,532,920 | B1 | 3/2003 | Sweetnam | |
| 6,976,461 | B2 * | 12/2005 | Rorig et al. | 123/90.16 |
| 7,240,652 | B2 * | 7/2007 | Roerig et al. | 123/90.39 |

FOREIGN PATENT DOCUMENTS

| | | | |
|---|---|---|---|
| DE | 697 18 569 | T2 | 1/2003 |
| DE | 10 2004 007 766 | A1 | 9/2004 |
| EP | 1 367 228 | A1 | 12/2003 |
| WO | WO 2005/005787 | A1 | 1/2005 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

A switchable drag lever (1) of a valve timing mechanism of an internal combustion engine having an outer lever (2), and inner lever (5) extending in the cut-out (3) of the said outer lever (2) between its side walls (4), the drag lever (1) having a rest (9) for a gas exchange valve on an underside (7) at one end (8) and a pivoting bearing (11) for supporting element at the other end (10) with the levers (2,5) extending at the end (8) on a common pin (12).

12 Claims, 1 Drawing Sheet

SWITCHABLE DRAG LEVER OF A VALVE TIMING MECHANISM OF AN INTERNAL COMBUSTION ENGINE

FIELD OF THE INVENTION

The invention relates to a switchable drag lever of a valve timing mechanism of an internal combustion engine, having an outer lever, an inner lever extending with its arms in the cut-out of the said outer lever between its side walls, a rest for a gas exchange valve being intrinsic to the drag lever on an underside at one end, and a pivoting bearing being intrinsic to the drag lever at the other end, the levers extending at one of the ends on a common pin and having receptacles for at least one coupling means which extend longitudinally at the end facing away from the pin and are aligned with respect to one another in the cam base circle, which coupling means can be displaced for coupling the levers in sections in or below the receptacle which lies opposite, and at least one of the levers being provided with a cam contact face on its upper side.

BACKGROUND OF THE INVENTION

In order to produce an aligned position of receptacles for coupling means in the cam base circle in levers which are already known from the prior art, a respective outer lever has a stop which engages in the manner of a bracket under the corresponding inner lever approximately in the region of the transverse centre plane. On account of the necessary transition radii of this bracket-like stop from the arms of the outer lever, as viewed in the transverse direction, a drag lever of this type has to be of relatively wide construction, as the inner lever cannot come into contact with an upper side of the transverse bracket in the radii region. If, nevertheless, there is contact in the region of the radii, unnecessarily high material loading is to be expected. States can also occur, in which there is not sufficient alignment of the coupling means with respect to the receptacle which lies opposite, with the result that coupling cannot be realized.

Secondly, it is obvious that, on account of the transverse bracket which engages over the underside of the inner lever, the drag lever is of unnecessarily deep construction. Here, problems can occur with free movement in the region of the cylinder head.

OBJECT OF THE INVENTION

It is therefore an object of the invention to provide a drag lever of the abovementioned generic type, in which the disadvantages described are eliminated.

ACHIEVEMENT OF THE OBJECT

According to the invention, this object is achieved in that a segment-like projection protrudes longitudinally into the cut-out from the outer lever in the region of its end which faces away from the pin, the bottom face of the said segment-like projection bearing against a complementary stop piece of the adjacent upper side of a pivoting-away end of the inner lever in the coupling case.

The above-described disadvantages are therefore eliminated. The scope of protection of this invention also relates to solutions for switchable drag levers, in which what is known as "transverse locking" is applied.

On account of the internal stop measures which are proposed here and are preferably configured in one piece on the respective lever parts, the abovementioned bracket-like stop which engages under the inner lever can be omitted. Alignment of the receptacles for the at least one coupling means is therefore provided in the cam base circle in a simple way.

At the same time, as is the subject-matter of a subclaim, these stop measures can realize a freedom of movement of one of the cam contact faces (preferably the inner lever here) in the cam base circle in relation to the respective cam. As a result of the lastmentioned measure, structural redundancy is avoided and, at the same time, base circle friction is reduced.

The measures according to the invention can be implemented in a switchable drag lever according to the system "lifting switch-off means" or "lifting switchover means". In contrast to the lever from the prior art, the proposed lever is of relatively narrow construction. It can therefore also be used in constricted installation-space conditions and is present in a mass-reduced form.

The bottom face of the projection is preferably to be complementary to the mating face on the stop piece. Flat engagement structures and also partially cylindrical engagement structures are suitable here. It is important to provide a relatively wide contact face which is optionally protected against wear separately, in order to keep the Hertzian stress low.

In a concrete form of the invention, the segment-like projection can emerge in one piece from the upper side of the outer lever or else be applied to a transverse web which is ultimately formed on the outer lever together with vane-like cam contact faces.

In a development of the invention, it is provided that the receptacle for the coupling means is configured on the inner lever on the underside of the pivoting-away end of the inner lever, and as a simple stop bar. This measure is particularly favourable with regard to the manufacturing costs. There is optionally also provision to apply a hole or a similarly suitable opening in the end side of the inner lever in this region.

Sliding faces on the outer lever can be suitable in general as cam following faces. The inner lever can, however, also have a sliding face as cam following face of a roller. As an alternative, the outer lever can also have rollers as cam followers.

It is particularly advantageous if the sliding faces are configured as cam contact faces on the outer lever and the transverse web which connects them is configured in one piece with the side walls of the outer lever. The cam contact faces can also optionally be aligned with respect to upper sides of the side walls.

In order to provide a cam follower with a sufficient width, it is proposed to allow the cam contact faces of the outer lever to protrude outwards beyond the side walls of the latter in the manner of vanes. In order for these vane-like or segment-like cam contact faces to be supported satisfactorily, it is proposed, moreover, to allow at the end side in each case one finger-like carrier to protrude from them in the direction away from the cam, which finger-like carrier is supported on an outer face of the respective side wall.

In addition, it is proposed to manufacture at least one of the levers from a lightweight material such as steel sheet or the like. Composite materials or plastics are also optionally suitable.

Via the pivoting bearing on the outer lever, it is possible in a simple manner to guide hydraulic medium out of the head of the associated supporting element to the receptacle for the coupling means which preferably lies above it. The rest for the gas exchange valve then lies at the other end, as viewed in the longitudinal direction of the drag lever.

BRIEF DESCRIPTION OF THE DRAWING

The invention is expediently explained in greater detail using the drawing, in which.

DETAILED DESCRIPTION OF THE DRAWING

Figure 1:
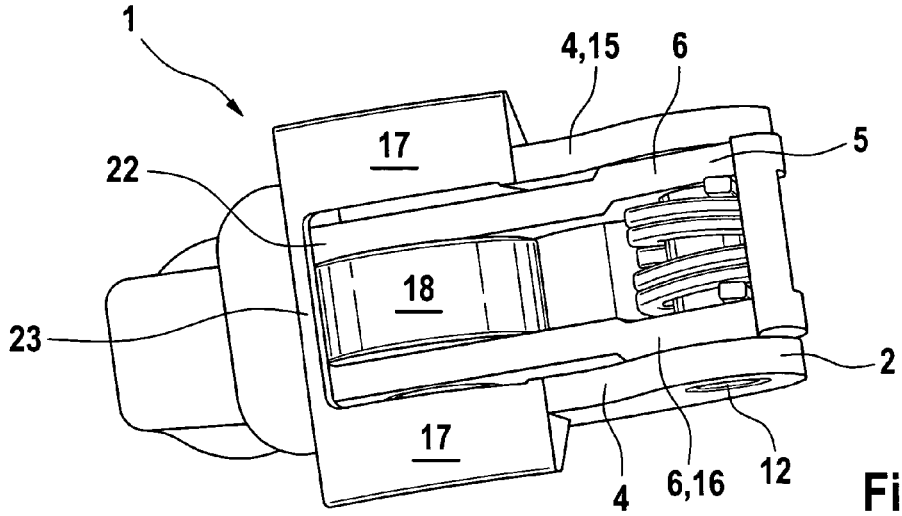
FIG. 1 shows a three-dimensional plan view of a drag lever according to the invention.

The figures disclose a switchable drag lever 1 for a valve timing mechanism of an internal combustion engine. The said drag lever 1 has an outer lever 2. An inner lever 5 is mounted between side walls 4 of the outer lever 2, which inner lever 5 has two arms 6 which are spaced apart and between which a roller runs as a cam contact face 18. This roller is roller-mounted, as FIG. 3 shows in greater detail.

At one end 10 on an underside 7, the outer lever 2 has a pivoting bearing 11 which is configured as a spherical cap. Via the said pivoting bearing 11, the said outer lever 2 can be mounted in a pivotably movable manner on a head of a supporting element which is, for example, hydraulic. At the other end 8, the outer lever 2 has a rest 9 on the underside 7 for at least one gas exchange valve (one gas exchange valve in concrete terms here).

Figure 3:
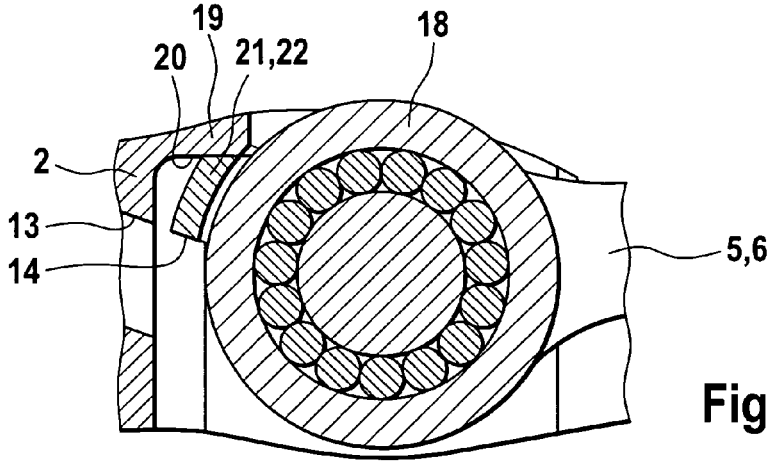
FIG. 3 shows a partial longitudinal section through the drag lever in the region of the stop piece.

Moreover, FIG. 3 discloses that the outer lever 2 has a receptacle 13 above the pivoting bearing 11, which receptacle 13 extends longitudinally here. In the decoupling case, a piston-like coupling means (not shown in the drawing) is seated in the said receptacle 13. The said coupling means can be displaced for the coupling case in the cam base circle below a complementary receptacle 14 of an end-side stop piece 21 of the inner lever 5.

A pin 12 is positioned at the other end 8 of the drag lever 1. The levers 2, 5 are arranged on the said pin 12 such that they can be moved pivotably relative to one another. A swivel pin spring is arranged as a lost-motion spring on the pin 12 between the arms 6 of the inner lever 5.

Figure 2:
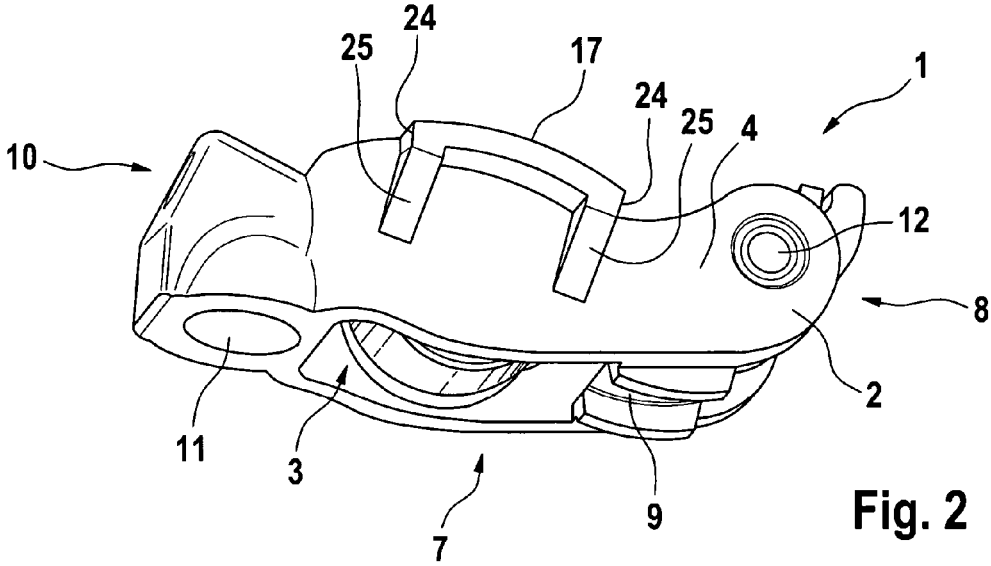
FIG. 2 shows a three-dimensional bottom view of the abovementioned drag lever.

It can be seen in FIGS. 1 and 2 that segment-like sliding faces are provided as cam contact faces 17 for lifting cams on upper sides 15 of the side walls 4 of the outer lever 2. The said segment-like sliding faces are connected on the side of the end 10 by a bracket-like transverse web 23. The transverse web 23 and the cam contact faces 17 are preferably configured in one piece with the outer lever 2.

As FIG. 2 shows in greater detail, finger-like carriers 25 extend in the direction away from the cam from ends 24 of the cam contact faces 17. The said carriers 25 form a highly satisfactory support for the cam contact faces 17 which protrude in sections beyond the side walls 4.

In addition, it can be gathered from FIG. 3 that a segment-like projection 19 protrudes longitudinally into a cut-out 3 between the side walls 4 of the outer lever 2 from the outer lever 2 in the region of its end 10 which faces away from the pin 12. The projection 19 has a bottom face 20 which, when the cam base circle is passed through and in the coupling case, rests on a complementary stop piece 21 of an adjacent upper side 16 of the pivoting-away end 22 of the inner lever 5. The said lastmentioned measures provide a simple height allocation of the receptacle 13 for the coupling means in the outer lever 2 in relation to its respective receptacle 14 on the inner lever 5. At the same time, the cam contact face 18 of the inner lever 5 is held without contact when the cam base circle is passed through via the said abovementioned stop. In contrast, the cam contact faces 17 are supported on the corresponding cam contours when the cam base circle is passed through (a base circle cam can be provided here, but does not have to be provided). "Pumping up" of the hydraulic supporting element which is known to experts is therefore avoided, the drag lever 1 preferably being supported on the said hydraulic supporting element via its pivoting bearing 11.

LIST OF REFERENCE NUMERALS

1) Drag lever
2) Outer lever
3) Cut-out
4) Side wall
5) Inner lever
6) Arm
7) Underside
8) End
9) Rest
10) End
11) Pivoting bearing
12) Pin
13) Receptacle
14) Receptacle
15) Upper side
16) Upper side
17) Cam contact face
18) Cam contact face
19) Projection
20) Bottom face
21) Stop piece
22) End
23) Transverse web
24) End
25) Carrier

The invention claimed is:

1. Switchable drag lever (1) of a valve timing mechanism of an internal combustion engine, having an outer lever (2), an inner lever (5) extending with its arms (6) in the cut-out (3) of the said outer lever (2) between its side walls (4), a rest (9) for a gas exchange valve being intrinsic to the drag lever (1) on an underside (7) at one end (8), and a pivoting bearing (11) being intrinsic to the drag lever (1) at the other end (10), the levers (2, 5) extending at one of the ends (8, 10) on a common pin (12) and having receptacles (13, 14) for at least one coupling means which extend longitudinally at the end (10, 8) facing away from the pin (12) and are aligned with respect to one another in the cam base circle, which coupling means can be displaced for coupling the levers (2, 5) in sections in or below the receptacle (14, 13) which lies opposite, and at least one of the levers (2, 5) being provided with a cam contact face (17, 18) on its upper side (15, 16), characterized in that a segment-like projection (19) protrudes longitudinally into the cut-out (3) from the outer lever (2) in the region of its end (10) which faces away from the pin (12), the bottom face (20) of the said segment-like projection (19) bearing against a complementary stop piece (21) of the adjacent upper side (16) of a pivoting-away end (22) of the inner lever (5) in the coupling case.

2. Drag lever according to claim 1, characterized in that the segment-like projection (19) emerges in one piece from the upper side (15) of the outer lever (2) or a height section which is close to the upper side (15).

3. Drag lever according to claim 1, characterized in that the receptacle (14) for the coupling means on the inner lever (5) is applied to the underside (7) of the pivoting-away end (22) of the inner lever (5) and is configured as a stop bar.

4. Drag lever according to claim 1, characterized in that sliding faces are provided as cam contact faces (17) for the lifting cams on the upper sides (15) of the side walls (4) of the outer lever (2).

5. Drag lever according to claim 4, characterized in that the cam contact faces (17) of the outer lever (2) are connected on the side of the end (10) which faces away from the pin (12) by a bracket-like transverse web (23).

6. Drag lever according to claim 5, characterized in that the transverse web (23) and the segment-like projection (19) form one structural unit.

7. Drag lever according to claim 4, characterized in that the cam contact faces (17) on the outer lever (2) protrude outwards beyond the side walls (4) of the said outer lever (2).

8. Drag lever according to claim 7, characterized in that in each case one finger-like carrier (25) runs in the direction of the underside (7) from end-side ends (24) of the cam contact faces (17) in the protruding region, which finger-like carrier (25) is connected to the corresponding side wall (4).

9. Drag lever according to claim 1, characterized in that a roller is accommodated between the arms (6) of the inner lever (5) as cam contact face (18) for a further lifting cam, the said cam contact face (18) being designed for following a large stroke and the cam contact faces (17) of the outer lever (2) being designed for following a stroke which is smaller in comparison or a zero stroke.

10. Drag lever according to claim 1, characterized in that, in the event of contact with the cam base circle, either the cam contact face (18) of the inner lever (5) or the cam contact faces (17) of the outer lever (2) are free of contact.

11. Drag lever according to claim 1, characterized in that at least one of the levers (2, 5) is composed of a lightweight material such as sheet metal.

12. Drag lever according to claim 1, characterized in that the rest (9) for the gas exchange valve and the pivoting bearing (11) are arranged on the outer lever (2), the pin (12) extending on the side of the rest (9).

* * * * *